US006927329B2

(12) United States Patent
Chen

(10) Patent No.: US 6,927,329 B2
(45) Date of Patent: Aug. 9, 2005

(54) SHOULDER REST FOR VIOLIN HAVING RACK RAIL BASED WIDTH ADJUSTMENT MECHANISM

(75) Inventor: Teddy Chen, Hsin-Tien (TW)

(73) Assignee: Dynasty Instrument Co., Ltd., Hsin-Chu (TW)

( * ) Notice: Subject to any disclaimer, the term of this patent is extended or adjusted under 35 U.S.C. 154(b) by 76 days.

(21) Appl. No.: 10/727,540

(22) Filed: Dec. 5, 2003

(65) Prior Publication Data

US 2005/0120860 A1 Jun. 9, 2005

(51) Int. Cl.[7] ..... G10D 1/02
(52) U.S. Cl. ..... 84/279; 84/278; 84/280
(58) Field of Search ..... 84/279, 278, 280

(56) References Cited

U.S. PATENT DOCUMENTS 5,419,226 A * 5/1995 Kun ..... 84/280
5,567,893 A * 10/1996 Kun ..... 84/280
6,031,163 A 2/2000 Cullum et al. ..... 84/279
6,680,431 B2 * 1/2004 Vanden et al. ..... 84/279

* cited by examiner

*Primary Examiner*—Shih-Yung Hsieh
(74) *Attorney, Agent, or Firm*—Rabin & Berdo, P.C.

(57) ABSTRACT

Shoulder rest for use with violin is disclosed. The rest includes a base including two half portions each including a central channel, a guide rail along either side of the base, a rack rail at either side of the channel, and two half sections each comprising clamping means; a support including a leg inserted into the channel, two latched members slidably fastened at underside of the channel, and two toothed stops engaged with the rack rail; and pivotal means comprising a body having a top hole for receiving a threaded stem of the clamping means, a parallel snapping element, and a bar interconnected the body and the snapping element, the bar being pivotal about a cavity of the support having a bifurcation sandwiched by the body and the snapping element. Two side flanges of the support are mounted to the guide rails. Thus, the support is moveable along the channel.

11 Claims, 7 Drawing Sheets

SHOULDER REST FOR VIOLIN HAVING RACK RAIL BASED WIDTH ADJUSTMENT MECHANISM

BACKGROUND OF THE INVENTION

1. Field of the Invention

The present invention relates to a shoulder rest for use with a violin or a violin-like instrument and more particularly to such a shoulder rest having a rack rail based mechanism adapted to perform a fine, precise width adjustment and having other improved characteristics.

2. Description of Related Art

Numerous shoulder rests for violin are provided in prior art. A particular type of such prior shoulder rest for violin is disclosed in U.S. Pat. No. 6,031,163 as shown in FIG. 1. It describes two supports 2 each having a number of openings 22 on its horizontal foot portion. Also, a number of threaded openings 51 are provided on a base 5. A thumbscrew 6 is driven through selected ones of the openings 22 and 51 for fastening the support 2 at the base 5. For adjusting a distance between the supports 2 (i.e., width of violin), unfastening the thumbscrew 6, aligning an unused opening 22 or 51 with another used or unused opening 51 or 22, and driving the thumbscrew 6 through the aligned openings 51 and 22 prior to fastening again will be sufficient.

But this is unsatisfactory for the purpose for which the invention is concerned for the following reasons: The spacing between two adjacent openings 22 or between two adjacent openings 51 is large (i.e., the number of openings 22 or 51 being small), thereby prohibiting a fine distance (i.e., width) adjustment between clamping elements 1. Moreover, the adjustment involves threadedly unfastening and fastening processes. Hence, it is time consuming. Thus, the need for improvement still exists.

SUMMARY OF THE INVENTION

It is an object of the present invention to provide a shoulder rest for violin or a violin-like instrument. The shoulder rest has a rack rail based mechanism capable of performing a precise, fine width adjustment (e.g., 2 mm per adjustment) thereof. The present invention further has the advantages of height adjustment, playing angle adjustment, and being detachable for easy storage.

To achieve the above and other objects, the present invention provides a shoulder rest for use with a violin or a violin-like instrument, the shoulder rest including an elongated, slightly curved base including two equal half portions, each half portion including an elongated, lengthwise extended, central channel, an enlarged hole at one end of the channel distal from one end of the base, a guide rail along either side of the base, a rack rail at either side of the channel, and two equal half sections, and a plurality of calibration marks (e.g., letters or numerals) along an inner side of one rack rail, each half section comprising: clamping means for engaging with a side wall of a body of the violin, the clamping means comprising a downwardly extending threaded stem; substantially L-shaped support means comprising a vertical bifurcation including a gradually enlarged opening, a substantially half-circular cavity, and two junctions between the gradually enlarged opening and the cavity, a horizontal foot portion having two side flanges, a projecting leg opposite the bifurcation, a transverse pin at an open end of the leg, the pin having a length about equal to a diameter of the enlarged hole, a pair of latched members projected from an underside of the foot portion, and two spaced toothed stops at both sides of the latched members; and disk-shaped pivotal means comprising a body member having a top hole for threadedly receiving the stem, a snapping element in spaced, parallel relationship with the body member wherein a distance between the snapping element and the body member is about a thickness of the bifurcation, and a cylindrical enlargement interconnected centers of the body member and the snapping element, the enlargement being rotatably fitted in the cavity with the bifurcation being sandwiched by the body member and the snapping element, whereby inserting the pin through the enlarged hole, and pressing the support means to insert the latched members through the channel for slidably fastening thereat with the flanges being mounted to the guide rails and the stops being engaged with teeth of the rack rail will enabling the support means to move along the channel.

In one aspect of the present invention, the pivotal means further comprises a ridge extended from the enlargement to a periphery of the body member, the ridge being parallel with the top hole, interconnected the body member and the snapping element, having a length of about radius of the snapping element, and being capable of pivoting clockwise or counterclockwise a predetermined angle defined by edges of the gradually enlarged opening.

In another aspect of the present invention, the pivotal means further comprises a downward, rectangular extension integrally formed with the snapping element, the extension being capable of pivoting clockwise or counterclockwise a predetermined angle defined by the flanges.

The above and other objects, features and advantages of the present invention will become apparent from the following detailed description taken with the accompanying drawings.

DETAILED DESCRIPTION OF THE PREFERRED EMBODIMENTS

Figure 1:
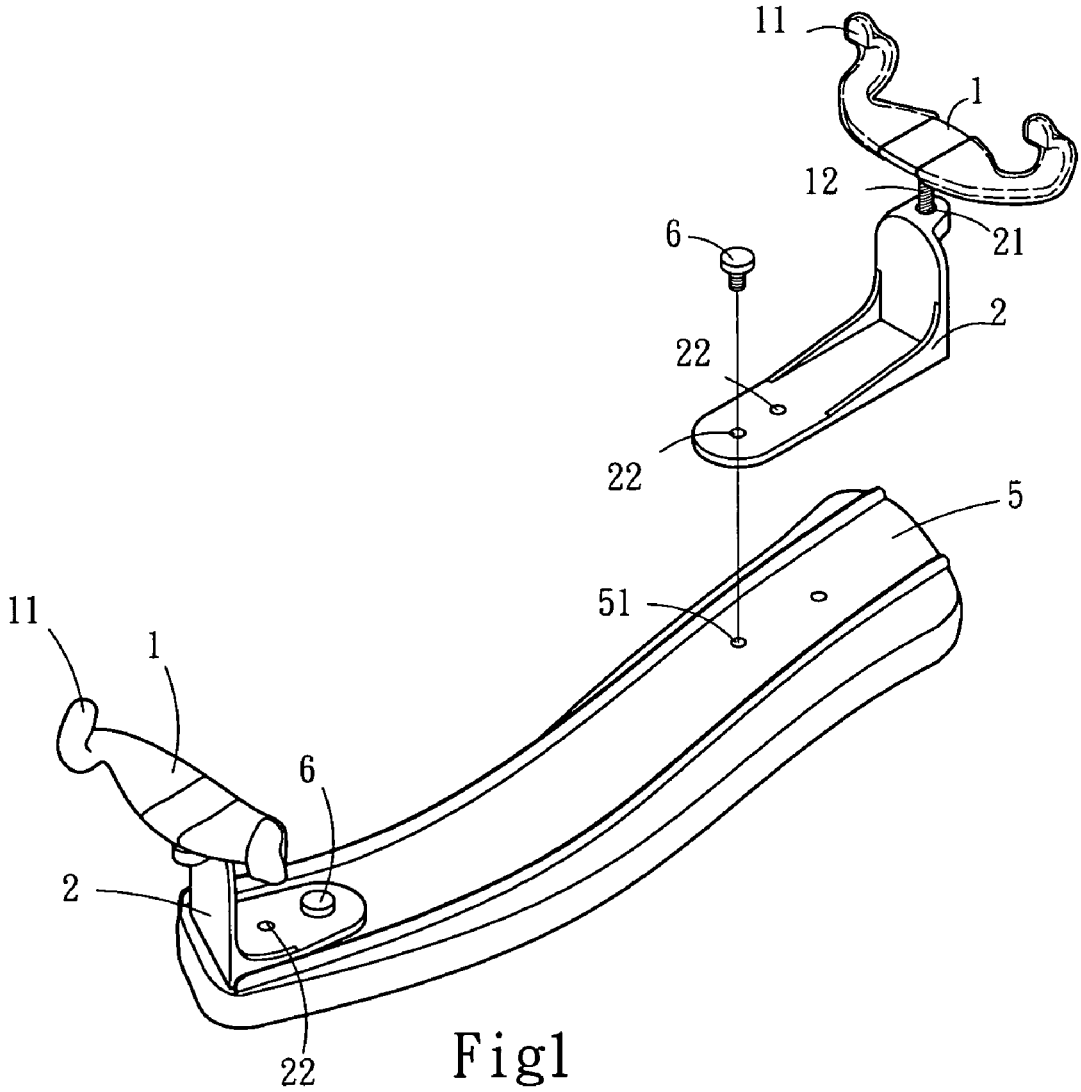
Fig1 (PRIOR ART)
FIG. 1 is an exploded perspective view of a conventional shoulder rest for violin.
Figure 2A:
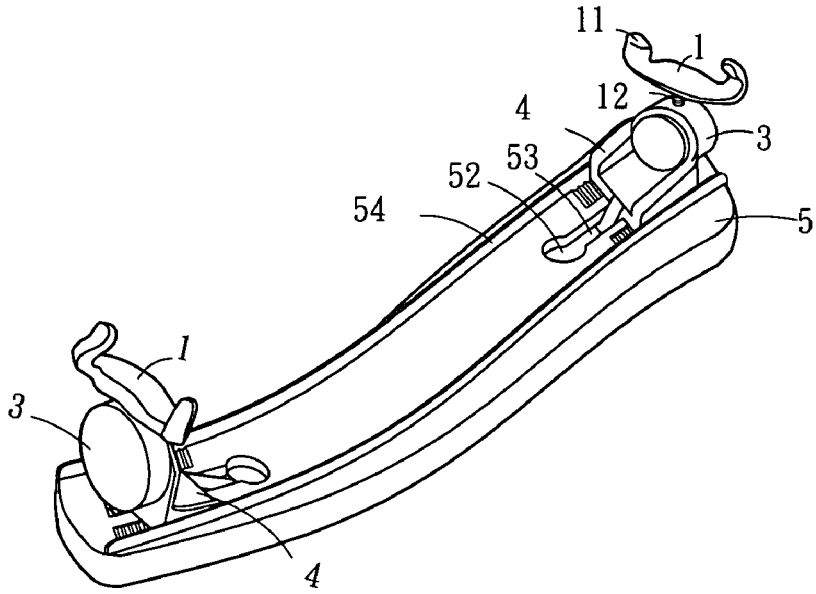
FIG. 2A is a perspective view of a shoulder rest for violin according to the invention.
Figure 2B:
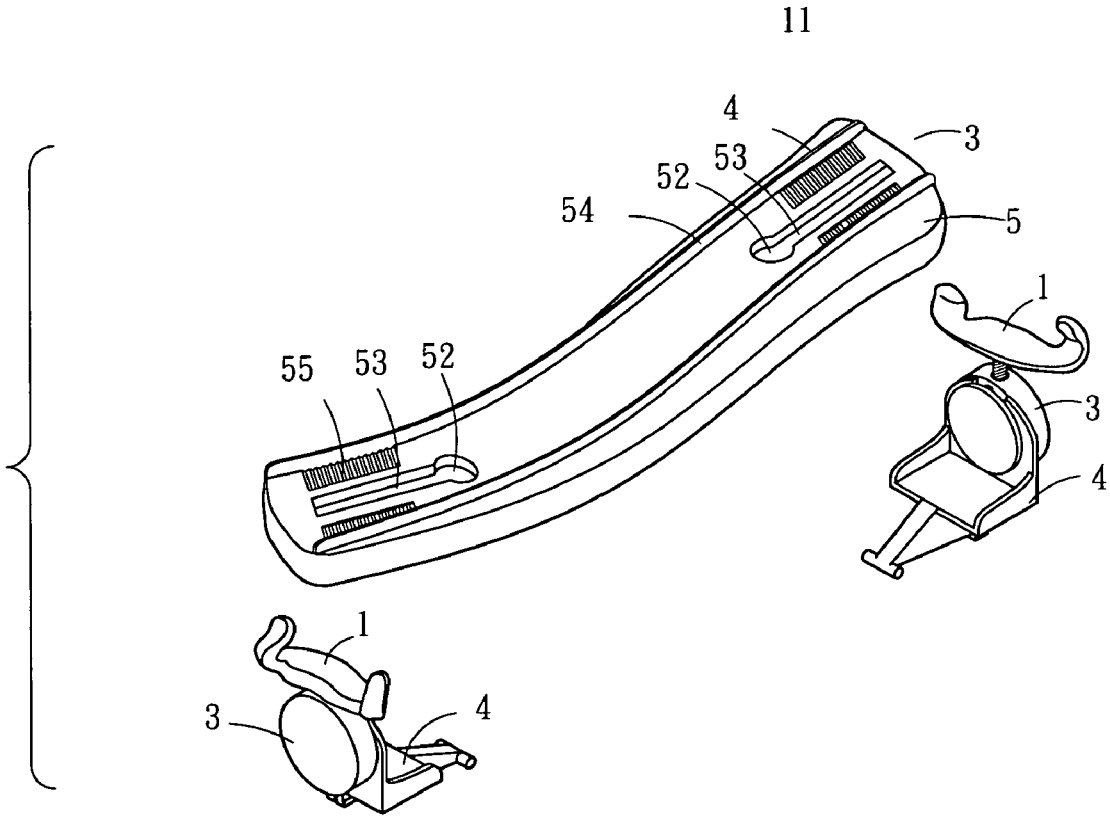
FIG. 2B is an exploded perspective view of the shoulder rest of FIG. 2A.

Referring to FIGS. 3 to 6, there is shown a shoulder rest for use with a violin in accordance with the invention. Note that only a right half portion of the shoulder rest will be described in detail below since a left half portion is a mirror image thereof as shown in FIG. 2A. In other words, the shoulder rest as described below means the right half portion of the whole shoulder rest. The shoulder rest comprises a clamping element 1, a pivotal member 3, a support 4, and a base 5. Each component will be described in detail below.

The clamping element 1 comprises a plastic foam padding 11 thereon, the padding 11 being adapted to engage with the side wall of the body of a violin, and a downwardly extending threaded stem 12. The substantially L-shaped support 4 comprises a vertical bifurcation 41 including a gradually enlarged opening 411, a substantially half-circular cavity 412, and two junctions 413 between the opening 411 and the cavity 412 wherein a distance between the junctions 413 is smaller than a diameter of the cavity 412; a horizontal foot portion having two side flanges 42; a lengthwise leg 43 opposite the bifurcation 41, a transverse pin 44 at an open end of the leg 43, a pair of latched members 45 projected from the underside of the foot portion, and two spaced toothed stops 46 at the underside of the foot portion proximate a junction of the foot portion and the bifurcation 41.

Figure 3:
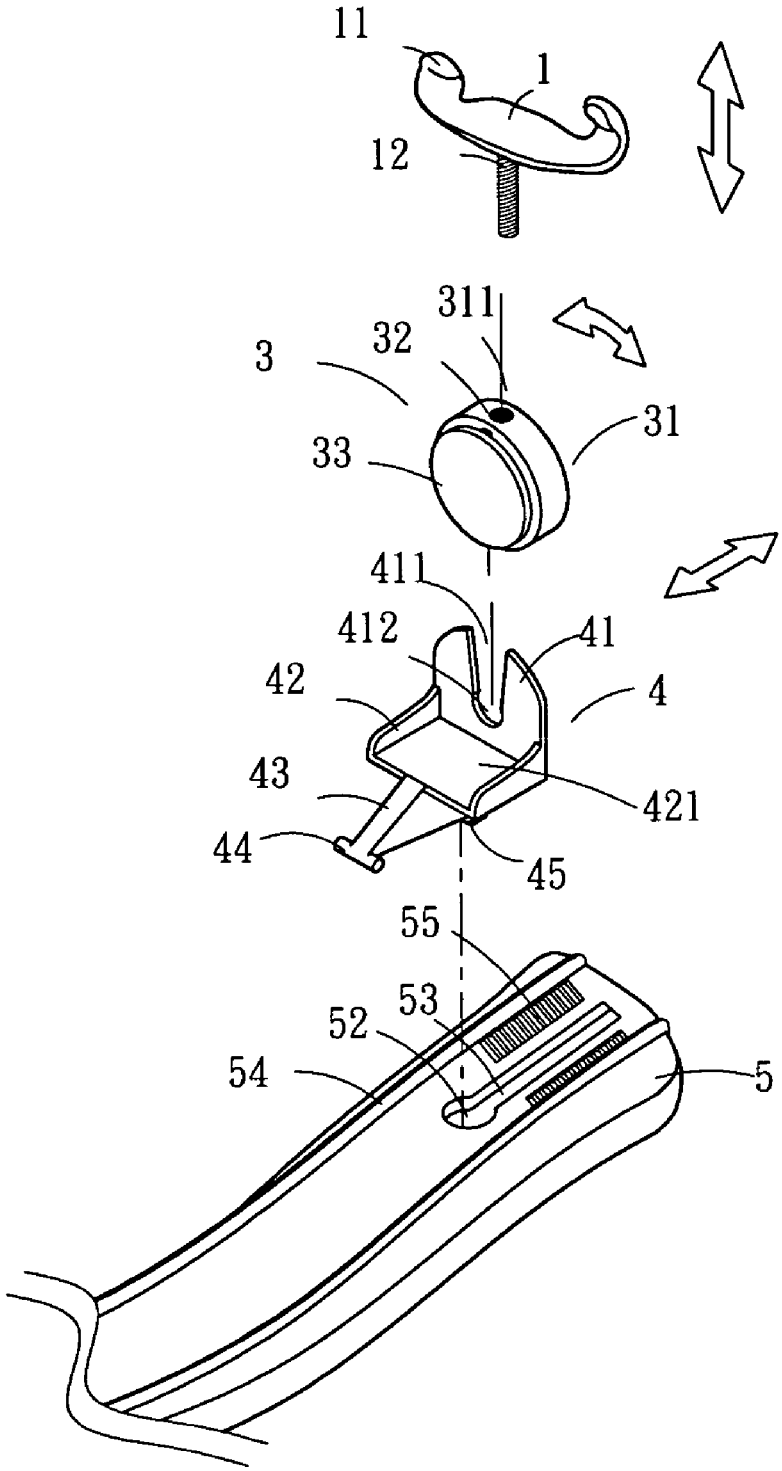
FIG. 3 is an exploded perspective view of a portion of the shoulder rest shown in FIG. 2B.
Figure 4A:
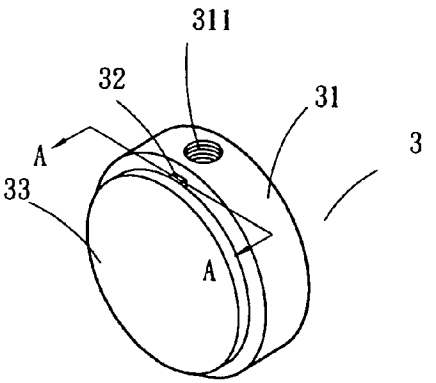
FIG. 4A is a perspective view of a first preferred embodiment of the pivotal member according to the invention.
Figure 4B:
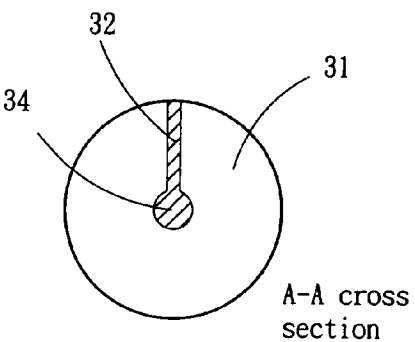
FIG. 4B is a cross-sectional view taken along A—A of FIG. 4A.
Figure 4C:
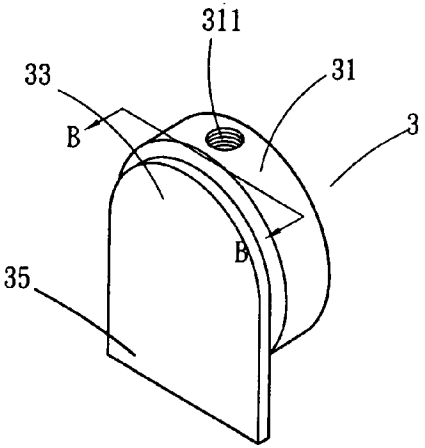
FIG. 4C is a perspective view of a second preferred embodiment of the pivotal member according to the invention.
Figure 4D:
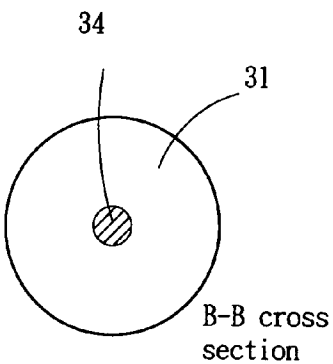
FIG. 4D is a cross-sectional view taken along B—B of FIG. 4C.
Figure 5A:
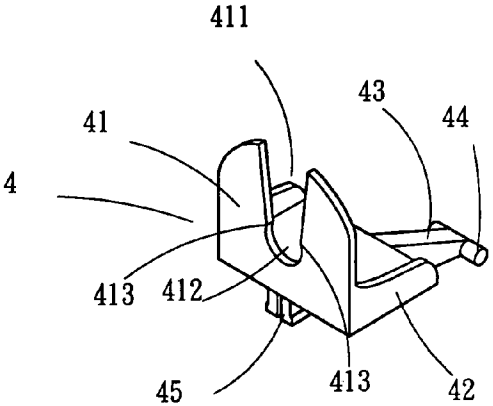
FIGS. 5A and 5B are two different perspective views of the support.
Figure 5B:
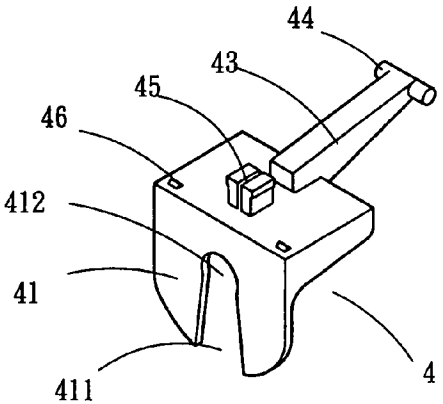
Figure 5C:
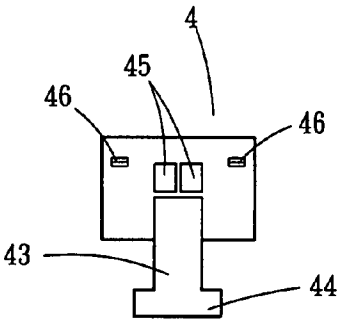
FIG. 5C is a bottom plan view of the support.
Figure 6A:
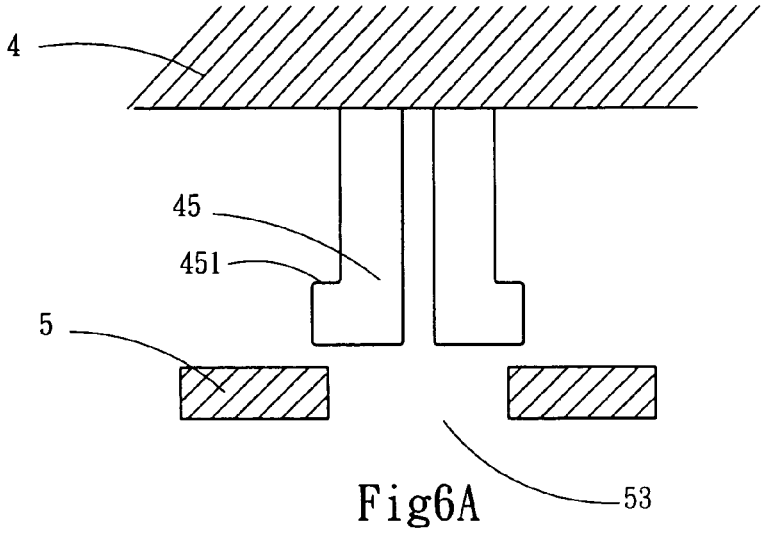
FIGS. 6A, 6B, and 6C are cross-sectional views of portions of the support and the base for illustrating the installation of the latched members at the channel.
Figure 6B:
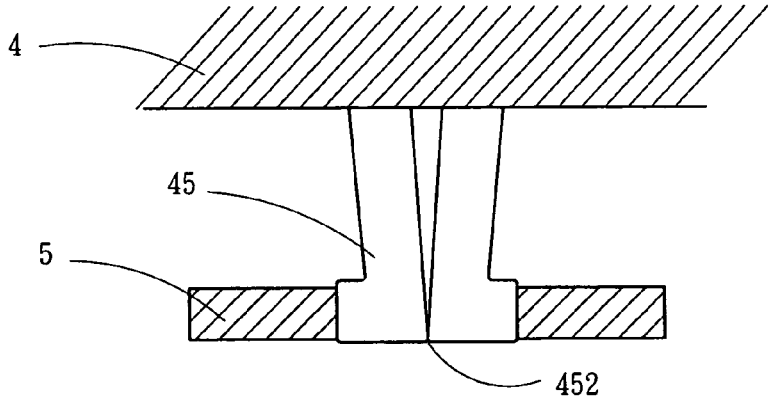
Figure 6C:
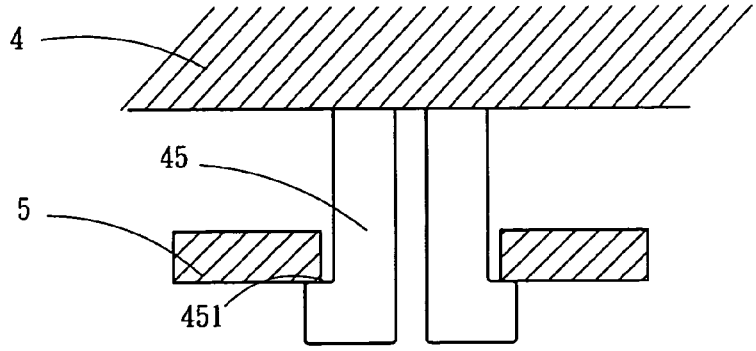
Figure 7A:
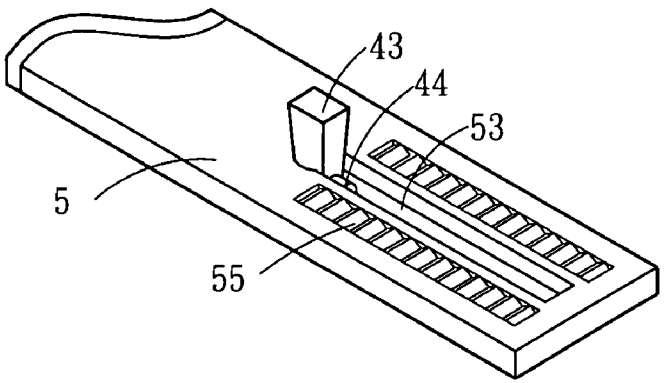
FIGS. 7A, 7B, 7C, 7D, and 7E are perspective views illustrating the movement of the support along the channel for width adjustment.
Figure 7B:
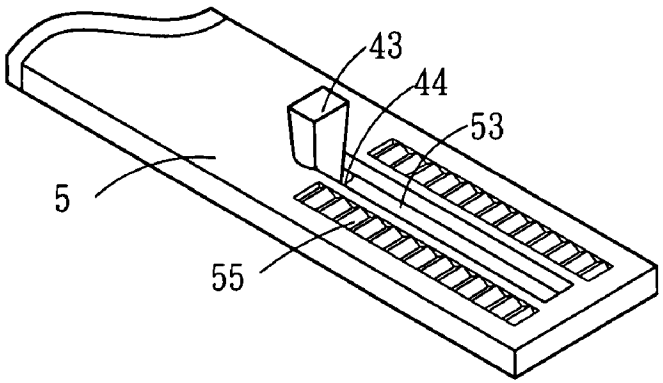
Figure 7C:
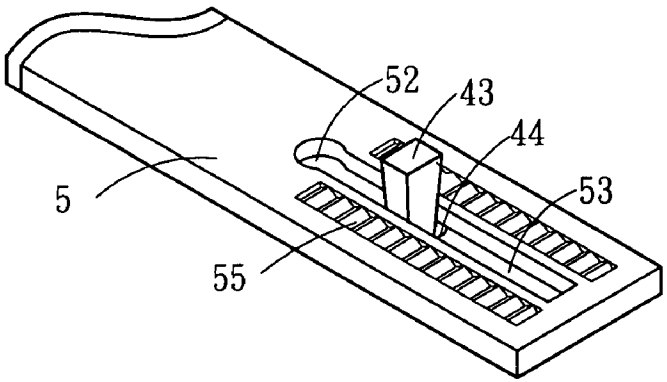
Figure 7E:
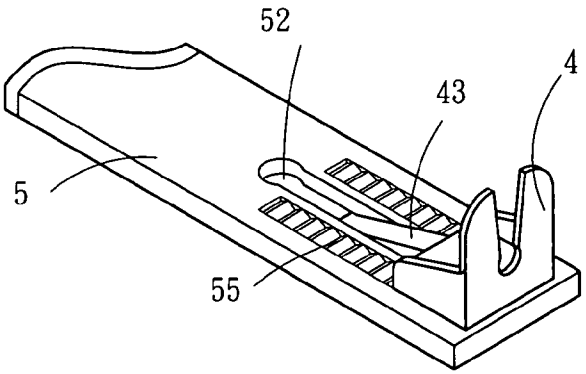
Figure 7D:
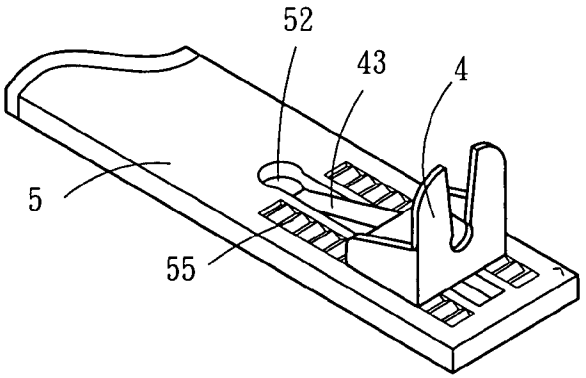

In a first preferred embodiment of the pivotal member 3 (FIGS. 4A and 4B), the disk-shaped pivotal member 3 comprises a body 31 having a top hole 311 for threadedly receiving the stem 12 (i.e., height of the clamping element 1 relative to the pivotal member 3 is adjustable and thus height of the shoulder rest is adjustable as indicated by a vertical arrow of FIG. 3), a spaced, parallel snapping element 33 wherein a distance between the snapping element 33 and the body 31 is about the thickness of the bifurcation 41, a ridge 32 about parallel with the hole 311, the ridge 32 being interconnected the body 31 and the snapping element 33 and having a length of about radius of the snapping element 33, and a cylindrical enlargement 34 interconnected centers of the body 31 and the snapping element 33 and provided at inner end of the ridge 32. The enlargement 34 is rotatably fitted in the cavity 412 with the bifurcation 41 being sandwiched by the body 31 and the snapping element 33. Hence, the ridge 32 is allowed to pivot clockwise or counterclockwise a predetermined angle defined by edges of the opening 411 (i.e., playing angle of violin is adjustable as indicated by an arcuate arrow of FIG. 3).

In a second preferred embodiment of the pivotal member 3 (FIGS. 4C and 4D), the pivotal member 3 comprises a disk-shaped body 31 having a top hole 311 for threadedly receiving the stem 12, (i.e., height of the clamping element 1 relative to the pivotal member 3 is adjustable and thus height of the shoulder rest is adjustable as indicated by a vertical arrow of FIG. 3), a spaced, parallel snapping element 33 wherein a distance between the snapping element 33 and the body 31 is about the thickness of the bifurcation 41, a cylindrical enlargement 34 interconnected centers of the body 31 and the snapping element 33, the enlargement 34 being rotatably fitted in the cavity 412 with the bifurcation 41 being sandwiched by the body 31 and the snapping element 33, and a downward, rectangular extension 33 integrally formed with the snapping element 33. The extension 33 is allowed to pivot clockwise or counterclockwise a predetermined angle defined by flanges 42 (i.e., playing angle of violin is adjustable as indicated by an arcuate arrow of FIG. 3).

The elongated, slightly curved base 5 comprises an elongated, lengthwise extended, central channel 53 open to its bottom, an enlarged, about circular hole 52 at one end of the channel 53 distal from one end of the base 5, a guide rail 54 along either side of the base 5, and a rack rail 55 at either side of the channel 53. An installation of the support 4 on the base 5 will now be described in detail below. First, insert the pin 44 through the hole 52 since length of the pin 44 is about equal to diameter of the hole 52. Next, push rearwardly and then press down the support 4 to compress hook portions 451 of the latched members 45 toward each other due to its flexible nature until the hook portions 451 contact at a point 452 as they contact the channel 53. Once the hook portions 451 pass the channel 53, the latched members 45 will expand outwardly for fastening thereat. At this position, the flanges 42 are mounted to the guide rails 54 and each stop 46 is engaged with a tooth of the rack rail 55.

Referring to FIGS. 7A to 7E, a user can push one or two of the supports 4 to move along one or two of the channels 53 for adjusting width of the shoulder rest as indicated by an oblique arrow of FIG. 3. Further, the engagement of the stops 46 with teeth of the rack rail 55 defines a horizontal movement of the support 4 along the channel 53. Furthermore, the latched members 45 limit a vertical movement of the support 4 to a minimum. Thus, the movement of the support 4 along the channel 53 is made smooth. Further, spacing between any two adjacent teeth of the rack rail 55 is about 2 mm. As a result, a fine, precise width adjustment of the shoulder rest is made possible.

Figure 8:
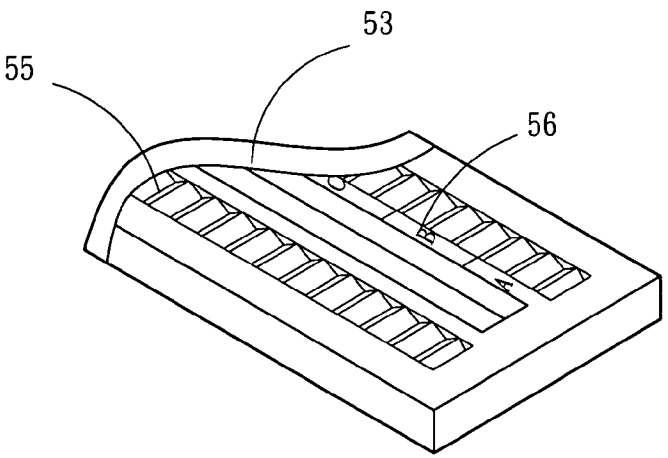
FIG. 8 is a perspective view showing the positions of calibration marks on the base.

Referring to FIG. 8, a plurality of calibration marks 56 indicated by numerals or letters (e.g., A, B and C as shown) are provided along an inner side of one rack rail 55. The provision of the calibration marks 56 aims at helping user memorize location of the support 4 on the base 5.

Note that all components (e.g., clamping elements 1, pivotal members 3, supports 4, and base 5) of the shoulder rest are detachable. Hence, its storage is made easy with less space being occupied.

While the invention herein disclosed has been described by means of specific embodiments, numerous modifications and variations could be made thereto by those skilled in the art without departing from the scope and spirit of the invention set forth in the claims.

What is claimed is:

1. A shoulder rest for use with a violin or a violin-like instrument, the shoulder rest including an elongated, slightly curved base including two equal half portions, each half portion including an elongated, lengthwise extended, central channel, an enlarged hole at one end of the channel distal from one end of the base, a guide rail along either side of the base, and a rack rail at either side of the channel, and two equal half sections, each half section comprising:

clamping means for engaging with a side wall of a body of the violin, the clamping means comprising a downwardly extending threaded stem;

substantially L-shaped support means comprising a vertical bifurcation including a gradually enlarged opening, a substantially half-circular cavity, and two junctions between the gradually enlarged opening and the cavity, a horizontal foot portion having two side flanges, a projecting leg opposite the bifurcation, a transverse pin at an open end of the leg, the pin having a length about equal to a diameter of the enlarged hole, a pair of latched members projected from an underside of the foot portion, and two spaced toothed stops at both sides of the latched members; and disk-shaped pivotal means comprising a body member having a top hole for threadedly receiving the stem, a snapping element in spaced, parallel relationship with the body member wherein a distance between the snapping element and the body member is about a thickness of the bifurcation, and a cylindrical enlargement interconnected centers of the body member and the snapping element, the enlargement being rotatably fitted in the cavity with the bifurcation being sandwiched by the body member and the snapping element, whereby inserting the pin through the enlarged hole, and pressing the support means to insert the latched members through the channel for slidably fastening thereat with the flanges being mounted to the guide rails and the stops being engaged with teeth of the rack rail provides the support means to move along the channel.

2. The shoulder rest of claim 1, wherein a spacing between any two adjacent teeth of the rack rail is about 2 mm.

3. The shoulder rest of claim 1, wherein the pivotal means further comprises a ridge extended from the enlargement to a periphery of the body member, the ridge being parallel with the top hole, interconnected the body member and the snapping element, having a length of about radius of the snapping element, and pivoting clockwise or counterclockwise a predetermined angle defined by edges of the gradually enlarged opening.

4. The shoulder rest of claim 1, wherein the pivotal means further comprises a downward, rectangular extension integrally formed with the snapping element, the extension pivoting clockwise or counterclockwise a predetermined angle defined by the flanges.

5. The shoulder rest of claim 1, wherein the enlarged hole is about circular.

6. The shoulder rest of claim 5, wherein the channel has a width less than a diameter of the enlarged hole.

7. The shoulder rest of claim 1, wherein a distance between the junctions is smaller than a diameter of the cavity.

8. The shoulder rest of claim 1, wherein the pin is perpendicular to the leg.

9. The shoulder rest of claim 1, further comprising a plurality of calibration marks along an inner side of one rack rail.

10. The shoulder rest of claim 9, wherein the calibration marks are numerals.

11. The shoulder rest of claim 9, wherein the calibration marks are letters.

* * * * *